US008326170B2

(12) United States Patent
Park

(10) Patent No.: US 8,326,170 B2
(45) Date of Patent: Dec. 4, 2012

(54) IMAGE FORMING APPARATUS INCLUDING CHIP HAVING ENGINE PROCESSOR AND BASIC PROCESSOR

(75) Inventor: Soo-Hee Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/370,667

(22) Filed: Feb. 10, 2012

(65) Prior Publication Data

US 2012/0134703 A1 May 31, 2012

Related U.S. Application Data

(62) Division of application No. 11/505,415, filed on Aug. 17, 2006, now Pat. No. 8,116,650.

(30) Foreign Application Priority Data

Aug. 31, 2005 (KR) ..... 2005-80613

(51) Int. Cl.
*G03G 15/00* (2006.01)

(52) U.S. Cl. ..... 399/75; 399/83

(58) Field of Classification Search ..... 399/75, 399/83

See application file for complete search history.

(56) References Cited

U.S. PATENT DOCUMENTS 6,226,463 B1 5/2001 Phillips et al.
8,159,696 B2 * 4/2012 Eom et al. ..... 399/107

FOREIGN PATENT DOCUMENTS

EP 0814598 A2 12/1997
JP 2005-142963 6/2005

* cited by examiner

*Primary Examiner* — Ryan Walsh
(74) *Attorney, Agent, or Firm* — Stanzione & Kim, LLP

(57) ABSTRACT

An image forming apparatus including a chip having an engine processor and a basic processor includes an image forming unit which has an image forming engine and forms an image of given image data, an engine processor to control a driving of the image forming engine, and a basic processor which is integrally provided with the engine processor and controls processes related to image formation except the driving of the image forming engine.

13 Claims, 3 Drawing Sheets

IMAGE FORMING APPARATUS INCLUDING CHIP HAVING ENGINE PROCESSOR AND BASIC PROCESSOR

CROSS-REFERENCE TO RELATED APPLICATIONS

This application is a Divisional Application of prior application Ser. No. 11/505,415, filed on Aug. 17, 2006 now U.S. Pat. No. 8,116,650, in the United States Patent and Trademark Office which claims the priority of Korean Patent Application No. 10-2005-0080613, filed on Aug. 31, 2005, in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to an image forming apparatus including a chip on which an engine processor and a basic processor are independently provided and share the control of processes related to the formation of an image of given print data.

2. Description of the Related Art

An image forming apparatus, such as a printer or a multi function peripheral having a printing function, forms an image from print data. Particularly, the image forming apparatus processes the print data, generates image data which can be processed by the image forming apparatus, and prints the image data, thereby forming the image of the print data on a print medium.

Processes related to image formation are performed under a control of a processor provided in the image forming apparatus. The processes related to image formation include various processes such as an image data generating process, a printing process, and so on, and can be performed by slaves provided in the image forming apparatus. The slaves operate under the control of the processor.

Among components provided in the image forming apparatus, components for printing the image data are collectively referred to as an image forming engine. It is necessary to suitably control the image forming engine to print the print data properly.

Accordingly, a driving state of the image forming engine must be frequently checked. In the processor provided in a conventional image forming apparatus, periodic interrupts are generated by operating a timer, which is one of the slaves, and the driving of the image forming engine is controlled whenever the interrupt is generated.

When the periodic interrupts are generated, the processor processes the periodic interrupts before other control processes. Accordingly, if the periodic interrupts are generated frequently, an amount of processing time increases, and thus a print speed of the image forming apparatus is reduced.

SUMMARY OF THE INVENTION

The present general inventive concept provides an image forming apparatus including a chip on which an engine processor and a basic processor are independently provided and share control of processes related to formation of an image of given print data.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an image forming apparatus, including a chip, an image forming unit which has an image forming engine to form an image of given image data, the engine processor to control driving of the image forming engine, and the basic processor integrally provided with the engine processor to control processes related to image formation except the driving of the image forming engine.

The image forming apparatus may also include a storing unit to store control contents of the engine processor, the engine processor may read the stored control contents and controls the driving of the image forming engine in accordance with the read control contents, and the storing unit may be provided separately from the engine processor and the basic processor.

The image forming apparatus may also include a storing unit to store control contents of the engine processor, the engine processor may read the stored control contents and controls the driving of the image forming engine in accordance with the read control contents, and the storing unit may be integrally provided with the engine processor and the basic processor.

The image forming apparatus may also include a storing unit to store control contents of the engine processor and the control contents of the basic processor, and the engine processor may read the stored control contents and controls the driving of the image forming engine in accordance with the read control contents.

The foregoing and/or other aspects and utilities of the present general inventive concept may also be achieved by providing an image forming apparatus to perform image formation operations from received print data, including an image forming unit to form the images and a chip to control the image formation, the chip including a first processor to control image formation operations other than the forming of the images and a second processor to control the image forming unit.

The foregoing and/or other aspects and utilities of the present general inventive concept may also be achieved by providing a chip usable in an image forming apparatus, including a first processor to control operations of the image forming apparatus other than image forming operations and a second processor to control the image forming operations.

The foregoing and/or other aspects and utilities of the present general inventive concept may also be achieved by providing an image forming apparatus, including a chip, a basic processor provided on the chip to control processes related to image formation other than an image forming process, and an engine processor provided on the chip to control the image forming process.

The foregoing and/or other aspects and utilities of the present general inventive concept may also be achieved by providing an image forming apparatus, including a basic processor to control processes related to image formation except for an image forming process and an engine processor integrally provided with the basic processor to control the image forming process.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
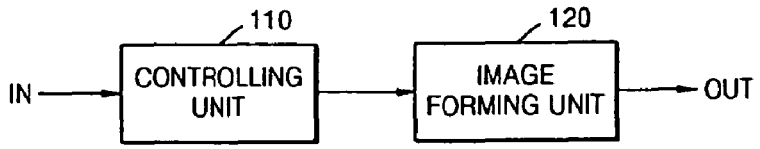
FIG. 1 is a block diagram illustrating an image forming apparatus including a chip having an engine processor and a basic processor, according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram illustrating an image forming apparatus including a chip having an engine processor and a basic processor, according to an embodiment of the present general inventive concept. Referring to FIG. 1, the image forming apparatus includes a controlling unit 110 and an image forming unit 120.

The image forming apparatus including the chip having the engine processor and the basic processor according to the present embodiment may be a printer or a multifunction peripheral (MFP) device having a printing function.

IN denotes print data. The print data may be given from a host to the image forming apparatus and may be directly given to the image forming apparatus.

OUT denotes an image of the print data, particularly a print medium on which the print data is printed.

The controlling unit 110 processes the given print data and generates image data which can be processed by the image forming apparatus, and the image forming unit 120 prints the image data to form the image. That is, the controlling unit 110 generates the image data from the print data. The image forming apparatus can use the image data to form the image on a printing medium.

A printing process, or an image forming process, is performed by the image forming unit 120. Processes related to image formation other than the image forming process, which is otherwise part of the image formation, are performed by the controlling unit 110. The processes related to image formation in total includes the image data generating process, the image forming process, etc.

The image forming process can include operations to control the image forming process other than the image data generating process of the image forming apparatus. For example, the image forming process can include controlling or driving the elements of the image forming apparatus, or the image forming engine, such as a photosensitive drum, a toner cartridge, a sheet feed device, etc.

The controlling unit 110 may include a basic processor (not illustrated), an engine processor (not illustrated), at least one master (not illustrated), at least one slave, and a storing unit (not illustrated). The controlling unit 110 may be realized as a system on chip (SoC).

The basic processor is provided in the image forming apparatus according to the present embodiment and can control all the processes related to the image formation other than the image forming process, which is part of the image formation. That is, the basic processor controls operations such as the image data generating process.

More particularly, the basic processor controls an operation of the slaves which perform all the processes related to image formation except the image forming process.

The basic processor may operate similar to a processor as provided in a conventional image forming apparatus.

The engine processor is additionally provided in the image forming apparatus according to the present embodiment and can control the image forming process. The engine processor may be integrally provided with the basic processor. For example, the engine processor and the basic processor can be provided on the same chip.

The engine processor controls the driving of the image forming engine (not illustrated) provided in the image forming unit 120. The storing unit stores a program to control the driving of the image forming engine. The engine processor instructs one of the at least one slave to perform operations of reading the stored program and generating a control signal corresponding to the program. The slave which receives this instruction generates the control signal, and the image forming engine operates in response to the control signal.

As described above, the image forming engine includes components to print the image data, such as the photosensitive drum, the toner cartridge, the sheet feed device, a feed roller, a carrier roller, a display, etc. Further, the image forming engine may include all the components provided in the image forming apparatus.

According to the present embodiment, the basic processor and the engine processor share the control of the processes related to image formation and are integrally provided on a single chip.

Figure 2:
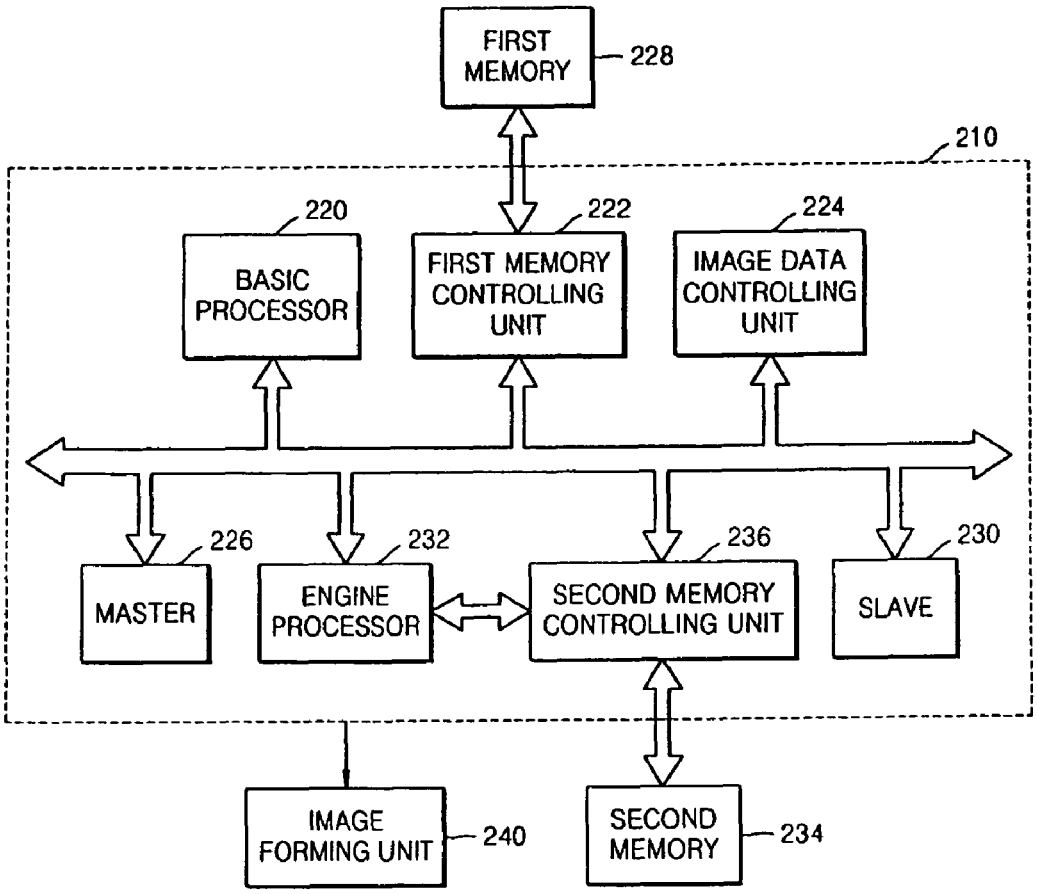
FIG. 2 is a block diagram illustrating an internal structure of a chip having an engine processor and a basic processor according to another embodiment of the present general inventive concept.

FIG. 2 is a block diagram illustrating an internal structure of a chip 210 having an engine processor 232 and a basic processor 220 according to another embodiment of the present general inventive concept. basic processor 220, a first memory controlling unit 222, an image data controlling unit 224, at least one master 226, a first memory 228, at least one slave 230, the engine processor 232, a second memory 234, a second memory controlling unit 236, and an image forming unit 240 are illustrated. However, the first memory 228 and the image forming unit 240 are provided external to the chip 210.

The basic processor 220, the first memory controlling unit 222, the image data controlling unit 224, the master 226, the at least one slave 230, the engine processor 232, and the second memory controlling unit 236 are provided on the chip 210. That is, the chip 210 can be a system on chip (SoC).

The basic processor 220 controls processes related to image formation other than the image forming process, which is part of the image formation. That is, the basic processor 220 controls operations such as an image data generating process. Particularly, the basic processor 220 controls operations of the slave(s) 230 to perform all the processes related to image formation other than the image forming process itself.

The first memory 228 stores a program having control contents of the basic processor 220, and the first memory controlling unit 222 reads the program stored in the first memory 228 in accordance with an instruction of the basic processor 220.

The basic processor 220 selects one of the at least one slave 230 corresponding to the read program and instructs the selected slave 230 to operate in accordance with the read program.

The basic processor 220 processes given print data. As described above with reference to FIG. 1, the given print data is received from an external source. The basic processor 220 then instructs the image data controlling unit 224 to generate image data from the print data.

The engine processor 232 controls the image forming process. That is, the engine processor 232 controls the image forming engine (formed therein) and other operations not related the image data generating process. Particularly, the engine processor 232 controls the operation of one of the at least one slave 230 to perform the image forming process.

The second memory 234 stores a program having control contents to drive the image forming engine provided in the image forming unit 240, and the second memory controlling unit 236 reads the program stored in the second memory 234 in accordance with an instruction of the engine processor 232. In the present embodiment, the second memory 234 is provided outside the chip 210.

The engine processor 232 selects one of the at least one slave 230 corresponding to the read program and instructs the selected slave 230 to operate in accordance with the read program. The image forming engine operates in response to the control signal generated by the selected slave 230, which operates in accordance with the instruction of the engine processor 232.

The image forming unit 240 forms an image of the given print data by printing the image data using the image forming engine. The image data is generated from the given print data by the basic processor 220 and the driving of the image forming engine is controlled by the engine processor 232.

As described above, according to the present embodiment, since the basic processor 220 and the engine processor 232 operate independently and share the processes related to image formation (i.e., the image data generating and the image forming process), an image forming speed of the image forming apparatus can be improved.

Figure 3:
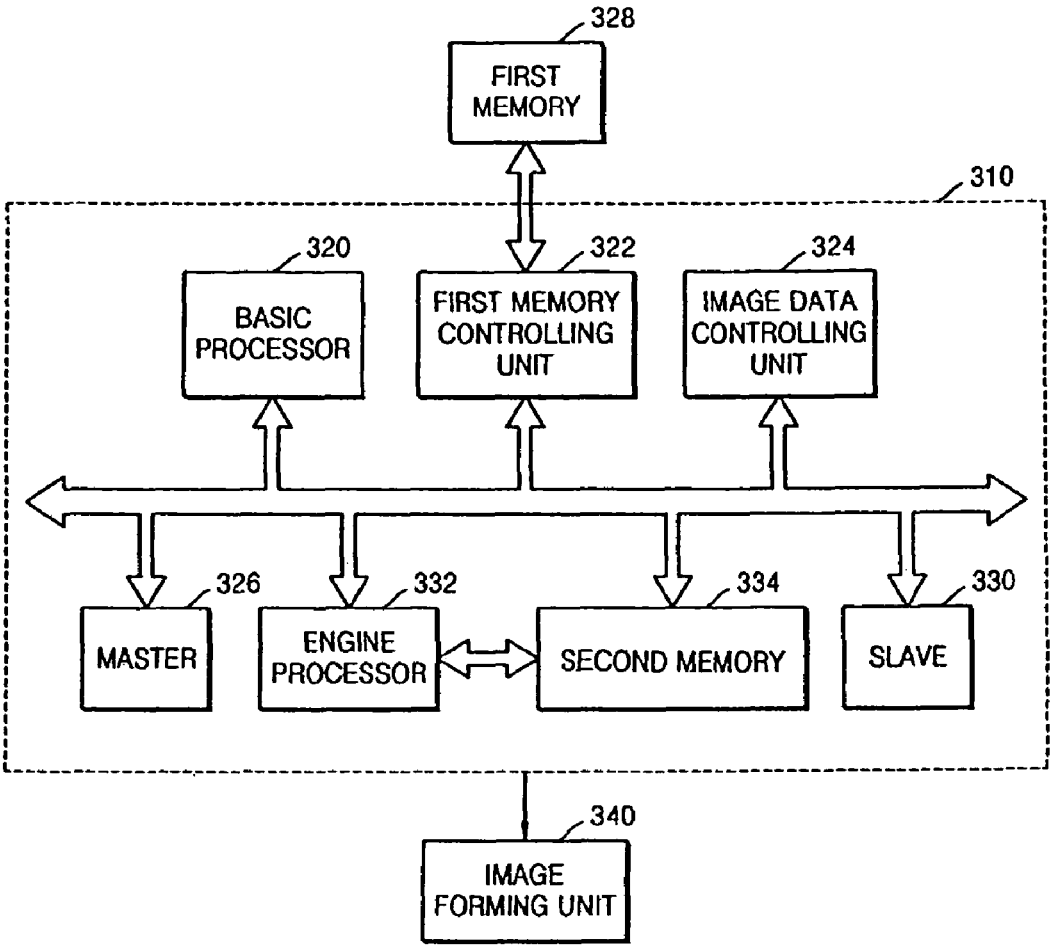
FIG. 3 is a block diagram illustrating an internal structure of a chip having an engine processor and a basic processor according to another embodiment of the present general inventive concept.

FIG. 3 is a block diagram illustrating an internal structure of a chip 310 having an engine processor 332 and a basic processor 320, according to another embodiment of the present general inventive concept. A basic processor 320, a first memory controlling unit 322, an image data controlling unit 324, at least one master 326, a first memory 328, at least one slave 330, the engine processor 332, a second memory 334, and an image forming unit 340 are illustrated. The first memory 328 and the image forming unit 340 are provided external to the chip 310.

The basic processor 320, the first memory controlling unit 322, the image data controlling unit 324, the master 326, the at least one slave 330, the engine processor 332, and the second memory 334 are provided on the chip 310. That is, the chip 310 can be a system on chip (SoC).

The basic processor 320 controls processes related to image formation other than the image forming process itself. That is, the basic processor 320 controls operations such as the image data generating process. Particularly, the basic processor 320 controls the operation of the slaves 330 to perform all the processes related to image formation other than the image forming process.

The first memory 328 stores a program having control contents of the basic processor 320, and the first memory controlling unit 322 reads the program stored in the first memory 328 in accordance with an instruction of the basic processor 320.

The basic processor 320 selects the at least one slave 330 corresponding to the read program and instructs the selected slave 330 to operate in accordance with the read program.

The basic processor 320 processes given print data and instructs the image data controlling unit 324 to generate image data from the given print data.

The engine processor 332 controls the image forming process. That is, the engine processor controls the image forming engine and other operations other than the image data generating process. Particularly, the engine processor 332 controls the operation of one of the at least one slave 330 to perform the image forming process.

The second memory 334 stores a program having control contents to drive an image forming engine provided in the image forming unit 340, and the engine processor 332 reads the program stored in the second memory 334. In the present embodiment, the second memory 334 is provided in the system on the chip 310.

The engine processor 332 selects one of the at least one slave 330 corresponding to the read program and instructs the selected slave 330 to operate in accordance with the read program. The image forming engine operates in response to a control signal generated by the selected slave 330 which operates in accordance with the instruction of the engine processor 332.

The image forming unit 340 forms an image from the given print data by printing the image data using the image forming engine. In the present embodiment, the image data is generated from the given print data by the basic processor 320 and the driving of the image forming engine is controlled by the engine processor 332.

As described above, according to the present embodiment, since the basic processor 320 and the engine processor 332 operate independently and share the processes related to image formation (i.e., the image data generating and the image forming process), an image forming speed of the image forming apparatus can be improved.

Figure 4:
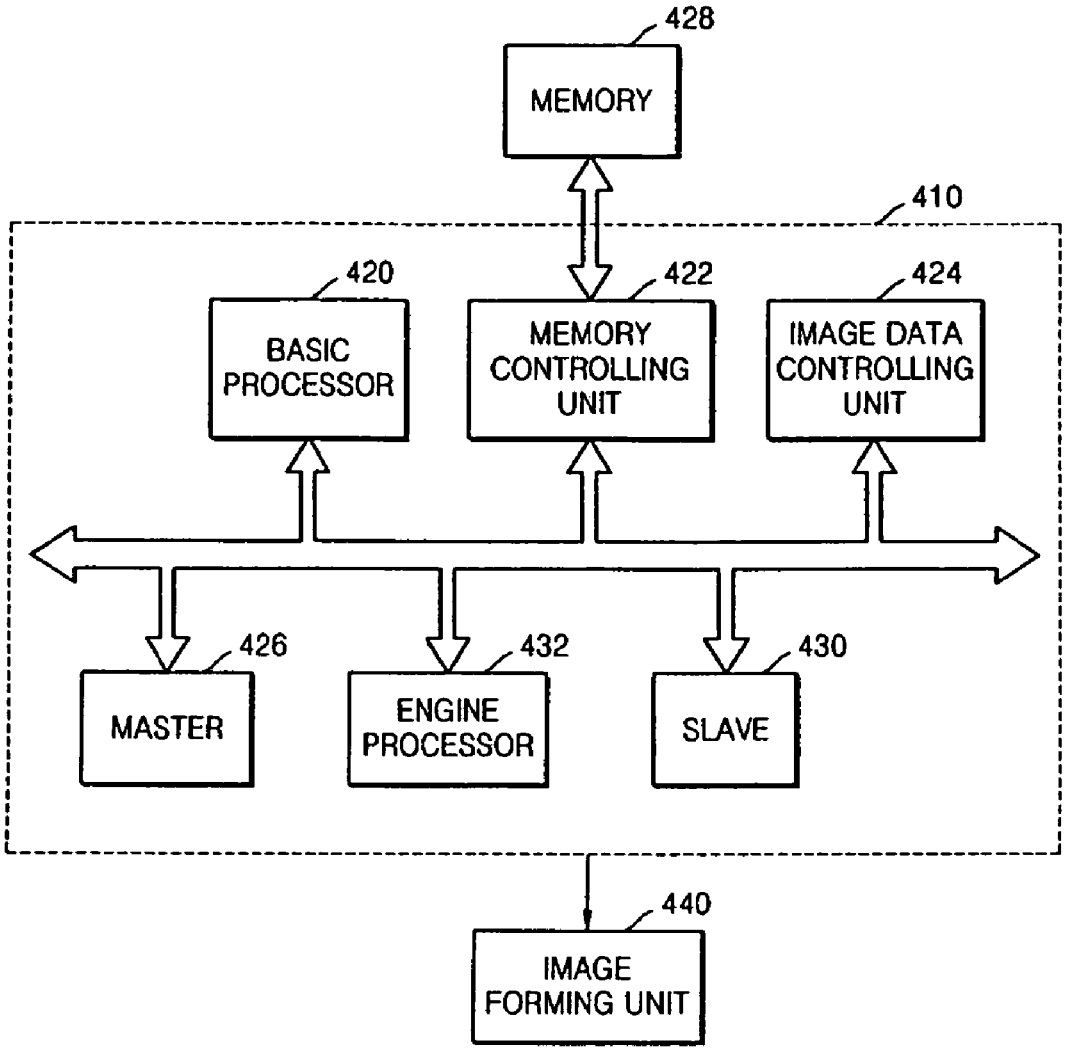
FIG. 4 is a block diagram illustrating an internal structure of a chip having an engine processor and a basic processor according to another embodiment of the present general inventive concept.

FIG. 4 is a block diagram illustrating an internal structure of a chip 410 having an engine processor 432 and a basic processor 420 according to another embodiment of the present general inventive concept. A basic processor 420, a memory controlling unit 422, an image data controlling unit 424, at least one master 426, a memory 428, at least one slave 430, the engine processor 432, and an image forming unit 440 are illustrated. The memory 428 and the image forming unit 440 are provided external to the chip 410.

The basic processor 420, the memory controlling unit 422, the image data controlling unit 424, the master 426, the slave 430, and the engine processor 432 are provided on the chip 410. That is, the chip 410 can be a system on chip (SoC).

The basic processor 420 controls the processes related to image formation other than the image forming process itself. That is, the basic processor 420 controls operations such as an image data generating process. Particularly, the basic processor 420 controls operations of the at least one slave 430 to perform all the processes related to image formation other than the image forming process itself.

The memory 428 stores a program having control contents of the basic processor 420, and the memory controlling unit 422 reads the program stored in the first memory 428 in accordance with an instruction of the basic processor 420.

The basic processor 420 selects one of the at least one slave 430 corresponding to the read program and instructs the selected slave 430 to operate in accordance with the read program.

The basic processor 420 processes given print data and instructs the image data controlling unit 424 to generate image data.

The engine processor 432 controls the image forming process itself. That is, the engine processor 432 controls the image forming engine and other operations of the image formation other than the image data generating process. Particularly, the engine processor 432 controls an operation of the at least one slave 430 to perform the image forming process.

Both the program having the control contents to drive the image forming engine provided in the image forming unit 440 and the program having the control contents of the basic processor 420 are stored in the memory 428.

That is, the memory 428 stores the program having control contents to drive the image forming engine provided in the image forming unit 440, and the memory controlling unit 422 reads the programs stored in the memory 428 in accordance with an instruction of the engine processor 432.

The engine processor 432 selects the at least one slave 430 corresponding to the read program and instructs the selected slave 430 to operate in accordance with the read program. The image forming engine operates in response to the control signal generated by the slave 430 which operates in accordance with the instruction of the engine processor 432.

The image forming unit 440 forms an image from the given print data by printing the image data using the image forming engine. In the present embodiment, the image data is generated from the given print data by the basic processor 420 and the driving of the image forming engine is controlled by the engine processor 432.

As described above, according to the present embodiment, since the basic processor 420 and the engine processor 432 operate independently and share the processes related to image formation (i.e., the image data generating and the image forming process), an image forming speed of the image forming apparatus can be improved.

As described above, an engine processor and a basic processor are independently provided on one chip and share control of processes related to image formation (i.e., the image data generating and the image forming process) of given print data, and the driving of an image forming engine is controlled by an engine processor which operates independently of the basic processor, Therefore, an operation of the basic processor need not be interrupted in order to control the driving of the image forming engine, and thus an image forming speed of the image forming apparatus can increase.

As described above, an engine processor and a basic processor are provided in one chip, an internal space of an image forming apparatus can be more efficiently used, as compared with using an external microcomputer to control the driving of an image forming engine. Thus, the image forming apparatus can be miniaturized and priced more competitively.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a chip;

an image forming unit which has an image forming engine to form an image of given image data;

an engine processor provided on the chip to control driving of the image forming engine;

a basic processor integrally provided with the engine processor on the chip to control an image data generating process related to image formation;

a first storing unit disposed outside the chip to store control contents of the basic processor;

a second storing unit disposed outside the chip to store control contents of the engine processor;

a first memory controlling unit provided on the chip to read the control contents of the basic processor from the first storing unit in response to a command from the basic processor; and a second memory controlling unit provided on the chip to read the control contents of the engine processor from the second storing unit in response to a command from the engine processor.

2. The image forming apparatus according to claim 1, wherein the engine processor controls the driving of the image forming engine in accordance with the read control contents.

3. An image forming apparatus to perform image formation operations from received print data, comprising:

an image forming unit to form the images;

a chip to control the image formation, the chip comprising:

a first processor to control an image data generating process related to image formation, a second processor to control the image forming unit, a first memory controller to read programs to control the first processor in response to a command from the first processor, and a second memory controller to read programs to control the second processor in response to a command from the second processor;

a first memory unit disposed outside the chip to store the programs to control the first processor; and a second memory unit disposed outside the chip to store the programs to control the second processor.

4. The image forming apparatus of claim 3, wherein the chip further comprises:

an image data control unit to generate image data according to a control of the first processor.

5. A chip usable in an image forming apparatus having an image forming engine, comprising:

a first processor to control an image data generating process related to image formation;

a second processor to control image forming operations of the image forming engine;

a first memory controlling unit to read control contents of the first processor from an external first storing unit in response to a command from the first processor; and a second memory controlling unit to read control contents of the second processor from an external second storing unit in response to a command from the second processor.

6. The chip of claim 5, wherein the image data generating process includes generating image data from print data input to the image forming apparatus.

7. An image forming apparatus having an image forming engine, comprising;

a chip;

a basic processor provided on the chip to control an image data generating process related to image formation;

an engine processor provided on the chip to control an image forming process of the image forming engine;

a first storing unit disposed outside the chip to store at least one program to control the basic processor to operate in accordance thereof;

a second storing unit disposed outside the chip to store at least one program to control the engine processor to operate in accordance thereof;

a first memory controlling unit provided on the chip to read the at least one program to control the basic processor from the first storing unit in response to a command from the basic processor a second memory controlling unit provided on the chip to read the at least one program to control the engine processor from the second storing unit in response to a command from the engine processor.

8. The image forming apparatus of claim 7, wherein the image forming process includes operations of the image forming apparatus not related to the image data generating process.

9. The image forming apparatus of claim 8, wherein the image forming process includes driving any of a photosensitive drum, a feed roller, a carrier roller, a display, a toner cartridge, and a sheet feed device.

10. The image forming apparatus of claim 7, wherein the image data generating process is a process to create image data.

11. The image forming apparatus of claim 7, wherein the image data generating process is a process to convert print data provided to the image forming apparatus to image data.

12. The image forming apparatus of claim 7, further comprising:

an image data controlling unit provided on the chip;

at least one slave corresponding to the at least one program to control the basic processor to operate in accordance thereof and the at least one program to control the engine processor to operate in accordance thereof.

13. An image forming apparatus, comprising:

an image forming engine to form an image of given image data;

a chip comprising:

a basic processor to control an image data generating process related to image formation;

an engine processor integrally provided with the basic processor to control an image forming process of the image forming engine; and a first memory controlling unit to read control contents of the basic processor from a first storing unit disposed outside the chip in response to a command from the basic processor;

a second memory controlling unit to read control contents of the engine processor from a second storing unit disposed outside the chip in response to a command from the engine processor.

* * * * *